US009839285B2

(12) United States Patent
Cassamajor

(10) Patent No.: US 9,839,285 B2
(45) Date of Patent: Dec. 12, 2017

(54) COMPUTER STAND

(71) Applicant: Bruce Cassamajor, Iselin, NJ (US)

(72) Inventor: Bruce Cassamajor, Iselin, NJ (US)

( * ) Notice: Subject to any disclaimer, the term of this patent is extended or adjusted under 35 U.S.C. 154(b) by 0 days.

(21) Appl. No.: 15/480,343

(22) Filed: Apr. 5, 2017

(65) Prior Publication Data

US 2017/0290417 A1 Oct. 12, 2017

Related U.S. Application Data

(60) Provisional application No. 62/319,101, filed on Apr. 6, 2016.

(51) Int. Cl.

| | |
|---|---|
| ***A47B 21/02*** | (2006.01) |
| ***A47B 9/06*** | (2006.01) |
| ***A47B 9/20*** | (2006.01) |
| ***A47B 21/03*** | (2006.01) |
| ***A47B 13/06*** | (2006.01) |

(52) U.S. Cl.

CPC ..... *A47B 21/02* (2013.01); *A47B 9/06* (2013.01); *A47B 9/20* (2013.01); *A47B 13/06* (2013.01); *A47B 21/0314* (2013.01); *A47B 2021/0335* (2013.01); *A47B 2200/0023* (2013.01); *A47B 2200/0054* (2013.01); *A47B 2200/0075* (2013.01); *A47B 2200/0087* (2013.01); *A47B 2200/0097* (2013.01)

(58) Field of Classification Search

CPC ..... A47B 21/02; A47B 21/0314; A47B 2021/0321; A47B 2021/0335; A47B 9/06; A47B 9/065; A47B 9/20; A47B 2200/0023; A47B 2200/0075; A47B 2200/0097

See application file for complete search history.

(56) References Cited

U.S. PATENT DOCUMENTS

| | | | | |
|---|---|---|---|---|
| 5,868,079 | A * | 2/1999 | Charny | A47B 21/00 108/147 |
| 2011/0023758 | A1* | 2/2011 | Overgaard | A47B 9/06 108/147 |
| 2014/0137773 | A1* | 5/2014 | Mandel | G06Q 10/109 108/50.11 |
| 2017/0013957 | A1* | 1/2017 | McRorie, III | A47B 21/02 |
| 2017/0049224 | A1* | 2/2017 | Kim | A47B 21/02 |
| 2017/0265643 | A1* | 9/2017 | Stolze | A47B 83/02 |

* cited by examiner

*Primary Examiner* — Daniel J Rohrhoff

(74) *Attorney, Agent, or Firm* — RG Patent Consulting, LLC; Rachel Gilboy

(57) ABSTRACT

An improved computer stand is an elevated computer support surface that allows users to comfortably stand, if desired, while taking up much less space than conventional computer desks. Fabricated of a durable wood material with a strong, metal-based support stem, this product would be adjustable to heights ranging from forty-two to sixty-two inches (35"-62"), and would feature a large surface width of thirty inches (30"). The improved computer stand would have two (2) tiers. The top section would be a flat rectangular piece that could easily support a laptop or computer monitor. The second tier, which would be tucked underneath the top space, would be hinge connected and adjustable in height. A footrest, attached at the base of the support stem, would offer a height adjustable place to relax the feet should one choose to sit on a tall stool or chair while working.

16 Claims, 4 Drawing Sheets

COMPUTER STAND

CROSS-REFERENCE TO RELATED APPLICATION

The present application is related to and claims priority from prior provisional application Ser. No. 62/319,101 filed Apr. 6, 2016 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of computer stands and more specifically relates to a specially designed, ergonomically sound computer desk assembly, complete with adjustable pieces, like a height adjustable fold away footrest, angle and height adjustable holding platform, desktop, dropdown keyboard, and height adjustable legs to provide a workstation that allows users to stand or sit while using a computer, at virtually any level desired, whether using a standard desk chair, an elevated chair or stool, or standing.

2. Description of the Related Art

While there is little or no manual labor involved with working at a desk, people who are employed in professions that entail this seemingly relaxing activity would readily attest to the physical demands of desk jobs. Not only can hours of staring at a computer screen strain the eyes and result in headaches, but prolonged periods seated at a desk can also engender pain and stiffness in the neck, shoulders, lower back, and legs areas. Whether operating a PC or a laptop, the body is often kept in a tense, upright position, or bent forward, for hours at a time. As a result, many who work the 9 to 5 office job or spend extended time at a home desk find themselves feeling as if they have just completed a day of digging ditches or nailing down roof shingles.

Various attempts have been made to solve the above-mentioned problems such as those found in U.S. Pat. No. D618,009 to Gary Lancet; U.S. Pat. No. 4,458,961 to Jess Browning; and U.S. Publication No. 20060054751 to Brian Johnson, et al. This art is representative of computer stands. None of the above inventions and patents, taken either singly or in combination, is seen to describe the invention as claimed.

Ideally, a computer stand should provide adjustable heights and positions to allow standing or sitting as desired by the user and, yet would operate reliably and be manufactured at a modest expense. Thus, a need exists for a reliable improved computer stand to avoid the above-mentioned problems.

BRIEF SUMMARY OF THE INVENTION

In view of the foregoing disadvantages inherent in the known computer stand art, the present invention provides a novel improved computer stand. The general purpose of the present invention, which will be described subsequently in greater detail is to provide a height adjustable, ergonomically correct computer desk assembly, with a height adjustable, and fold away foot rest; angle and height adjustable computer support surface, and keyboard support platform. The adjustable workstation allows a user to either sit, or stand at any level desired for comfort.

An improved computer stand is disclosed herein enabling a user to work on a computer while in a sitting or standing position, comprising a base member adapted to be placed on a floor surface, an adjustable support stem attached to the lower end of base member and adjustably extends vertically upwards from the base member. A computer support member includes a computer support surface having a width of 30 inches and rectangular in shape, formed as a platform member formed from wood adapted to extend horizontally and support a computer member thereon, and is connected to the upper end of the support stem. At least one support bracket member is connected between the support stem and a bottom surface of the computer support member for stability. An attachment portion is located in a position vertically spaced from and below the computer support surface. A keyboard support platform is connected to the attachment portion via a hinge member and a locking member, such that the keyboard support platform can be held in a horizontal position when in use and pivoted downwardly into a vertical position when not in use.

A foot rest member is connected to the support stem at a lower section thereof and adapted to support the feet of a user. The foot rest member includes a male connector member formed having a cylindrical shape adapted to be connected within the female connector member of the support stem and connected with the releasable connector member to vertically and pivotally adjustably connect the foot rest member to the support stem. The male connector member of the foot rest member comprises an extension arm extending therefrom and a ball member on a distal end of the extension arm, and the foot rest member includes a socket portion on a lower surface adapted to receive the ball member therein, such that the angle of the foot rest member with respect to the support stem can be adjusted.

The support stem includes at least two telescoping members formed from a metallic material connected to one another via a releasable connector and allows the computer support surface to be adjustable from 35" to 62" in height from the base member. The computer support member further includes a holder portion having a holding surface, and is located between the computer support surface and the attachment portion and angled relative to the computer support surface and adapted to hold material for a user to view while working on a computer.

The lower section of the support stem includes a female connector member attached thereto formed having a hollow cylindrical shape and a releasable connector member. The releasable connector between the two telescoping members is formed as a ratchet member and includes a handle portion adapted to allow a user to adjust the length of the two telescoping members and thereby the length of the support stem. The computer support member further comprises an elongated rectangular retainer portion attached to a back surface measuring 30 inches in length and a width of 2.5 inches adapted to retain objects on the computer support surface.

The present invention holds significant improvements and serves as an improved computer stand. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, improved computer stand constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a computer stand and more particularly to an improved computer stand as used to improve the ability of a user to utilize an adjustable height computer stand with a height adjustable footrest. The user is able to sit or stand to work, the top surface is angle adjustable, and the keyboard platform is hinged and able to fold down out of the way when not in use.

Generally speaking, improved computer stand is a specially designed elevated computer support surface that allows users to comfortably stand, if desired, while taking up much less space than conventional computer desks. Fabricated of a durable wood material with a strong, metal-based support stem, this product would be adjustable to heights ranging from forty-two to sixty-two inches (35"-62"), and would feature a large surface width of thirty inches (30"). The improved computer stand features two (2) tiers. The top section is a flat rectangular piece that can easily support a laptop or computer monitor. The second tier, which is tucked underneath the top space, is hinge connected and adjustable in height. The hinge connection allows the user to drop the keyboard platform down and out of the way when not in use. This surface can easily support an external keyboard and mouse. Between the two tiers is an angled holding platform, for use with tablets, or to hold paperwork, one's phone, or a calculator, etc. This platform is adjustable in angle and height. A footrest, attached at the base of the support stem, offers a height adjustable place to relax the feet should one choose to sit on a tall stool or chair while working. The footrest is able to fold out of the way when not in use.

Figure 1:
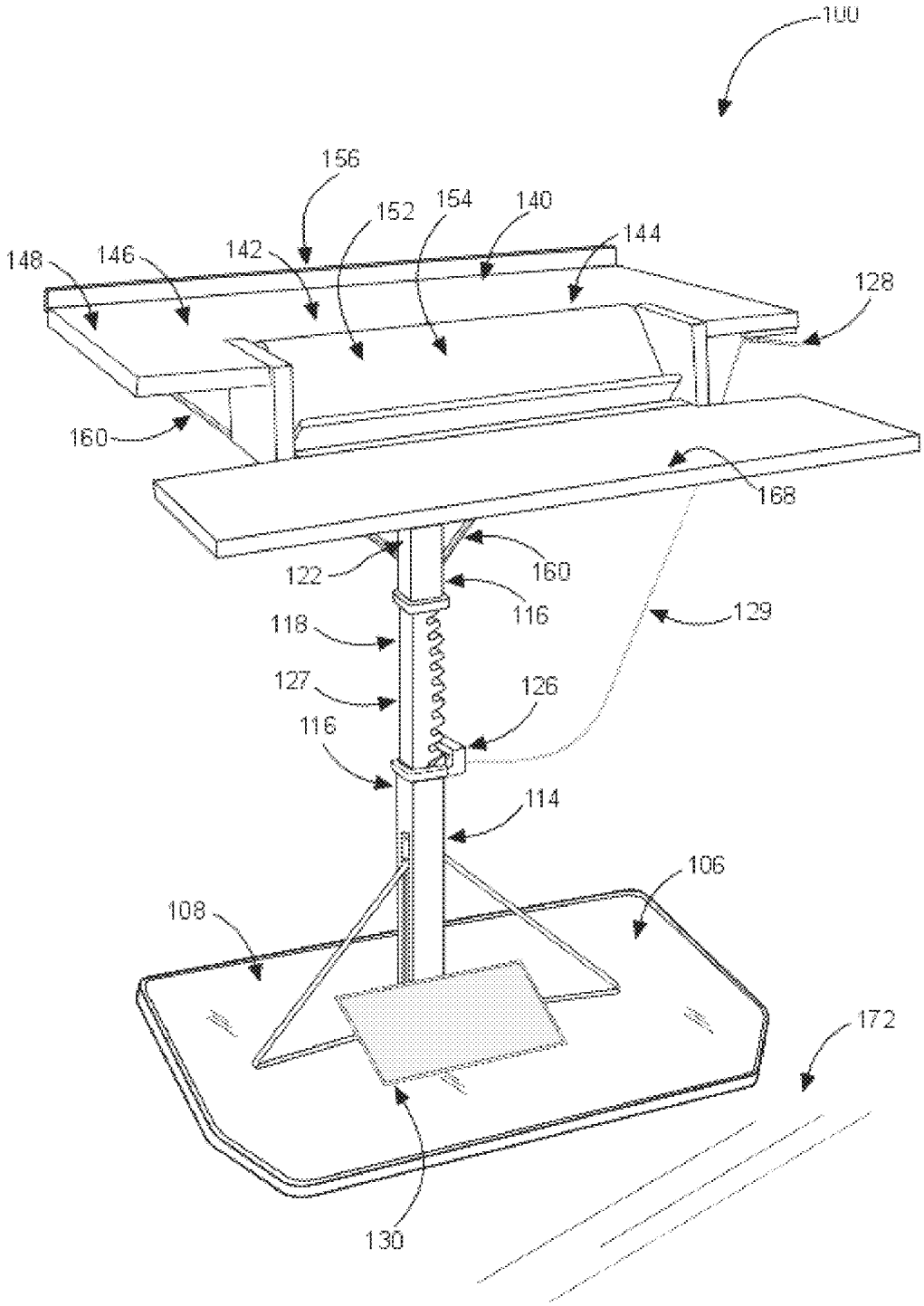
FIG. 1 shows a perspective view illustrating an improved computer stand with the keyboard support platform in a horizontal position according to an embodiment of the present invention.

Referring to the drawings by numerals of reference there is shown in FIG. 1, a perspective view illustrating an improved computer stand 100 with the keyboard support platform 168 in an upright, horizontal position according to an embodiment of the present invention.

Improved computer stand 100 is disclosed herein enabling a user to work on computer while in a sitting or standing position, comprising base member 106 adapted to be placed on floor surface 172, adjustable support stem 114 attached to top side 108 of base member 106 and adjustably extends vertically upwards from base member 106. Computer support member 140 includes computer support surface 142 having a width of 30 inches and rectangular 144 in shape, formed as platform member 146, formed from wood 148 adapted to extend horizontally and support thereon, and is connected to upper end 122 of support stem 114. At least one support bracket member 160 is connected between support stem 114 and bottom surface 150 of computer support member 140 for stability. Attachment portion 166 is located in a position vertically spaced from and below computer support surface 142. Keyboard support platform 168 is connected to attachment portion 166 via hinge member 176, such that keyboard support platform 168 can be held in a horizontal position when in use and pivoted downwardly 169 into a vertical position when not in use.

Figure 2:
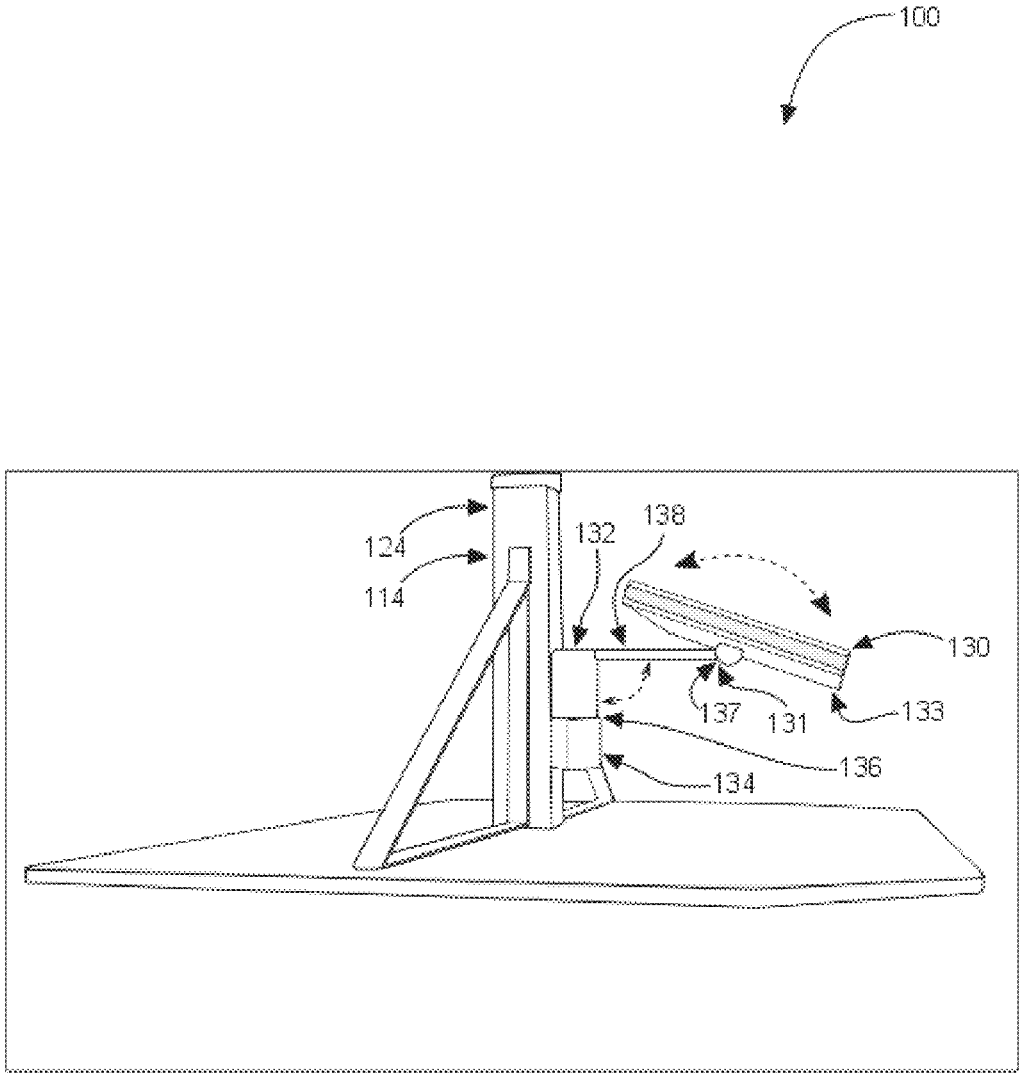
FIG. 2 is a side view illustrating the base member and foot rest member of improved computer stand according to an embodiment of the present invention of FIG. 1.

Referring now to FIG. 2, a side view illustrating the base member 106 and foot rest member 130 of improved computer stand 100 according to an embodiment of the present invention.

Foot rest member 130 is connected to support stem 114 at lower section 124 thereof and adapted to support the feet of a user. Foot rest member 130 includes male connector member 132 formed having a cylindrical shape adapted to be connected within female connector member 134 of support stem 114 and connected with releasable connector member 136 to vertically and pivotally connect foot rest member 130 to support stem 114. Male connector member 132 of foot rest member 130 comprises extension arm 138 extending therefrom and ball member 137 on a distal end of extension arm 138, and foot rest member 130 includes socket portion 131 on lower surface 133 adapted to receive ball member 137 therein, such that the angle of foot rest member 130 with respect to support stem 114 can be adjusted.

Figure 3:
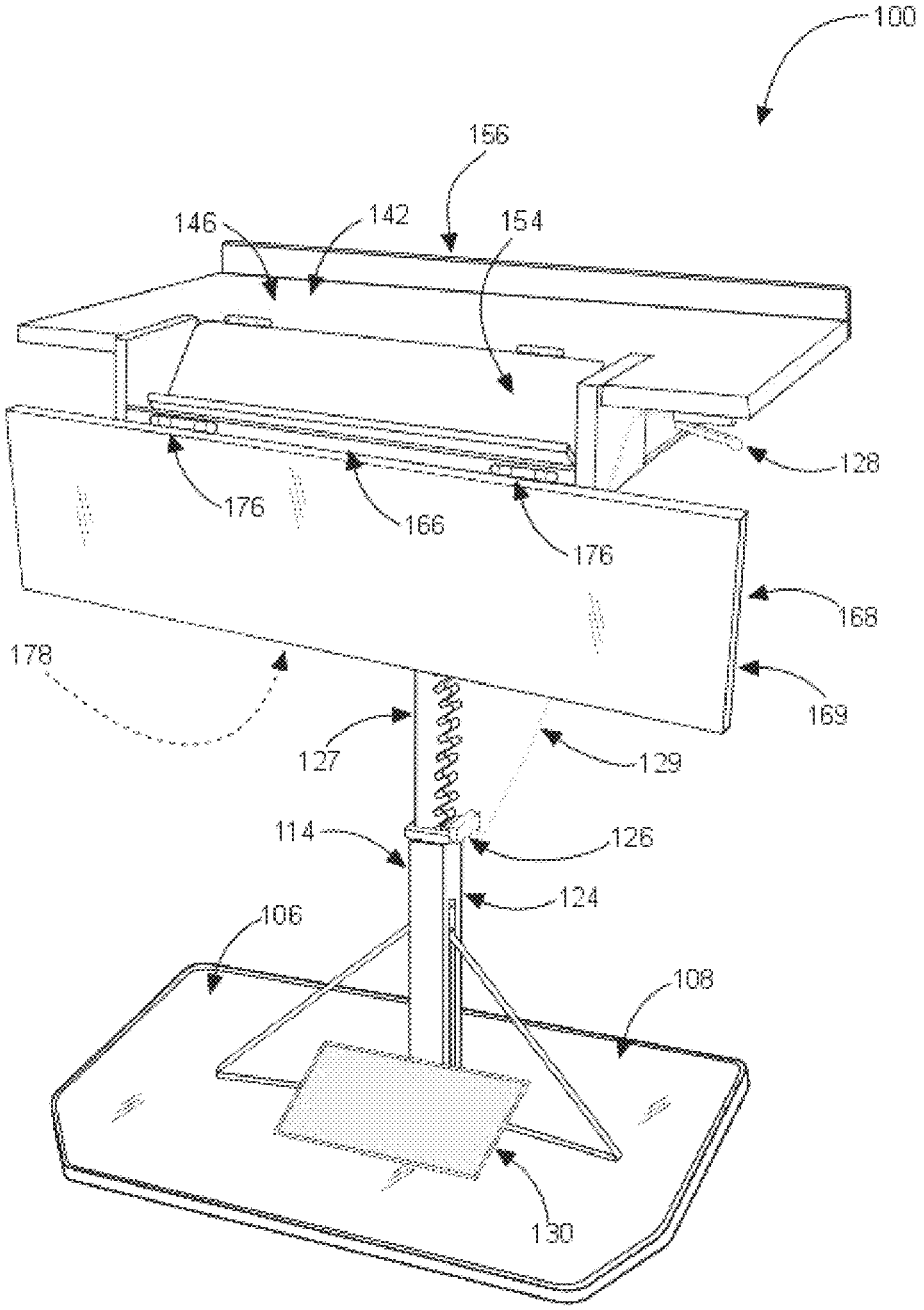
FIG. 3 is a perspective view illustrating an improved computer stand with keyboard support platform in a pivoted downwardly position according to an embodiment of the present invention of FIG. 1.

Referring now to FIG. 3, a perspective view illustrating an improved computer stand 100 with keyboard support platform 168 in a pivoted downwardly position 169 according to an embodiment of the present invention.

Support stem 114 includes at least two telescoping members 116 formed from metallic material 118 connected to one another via connector 120 and allows computer support surface 142 to be adjustable from 35" to 62" in height from base member 106. Computer support member 136 further includes holder portion 152 having holding surface 154, and is located between computer support surface 142 and attachment portion 166 and angled relative to computer support surface 142 and adapted to hold material for a user to view while working on computer.

Figure 4:
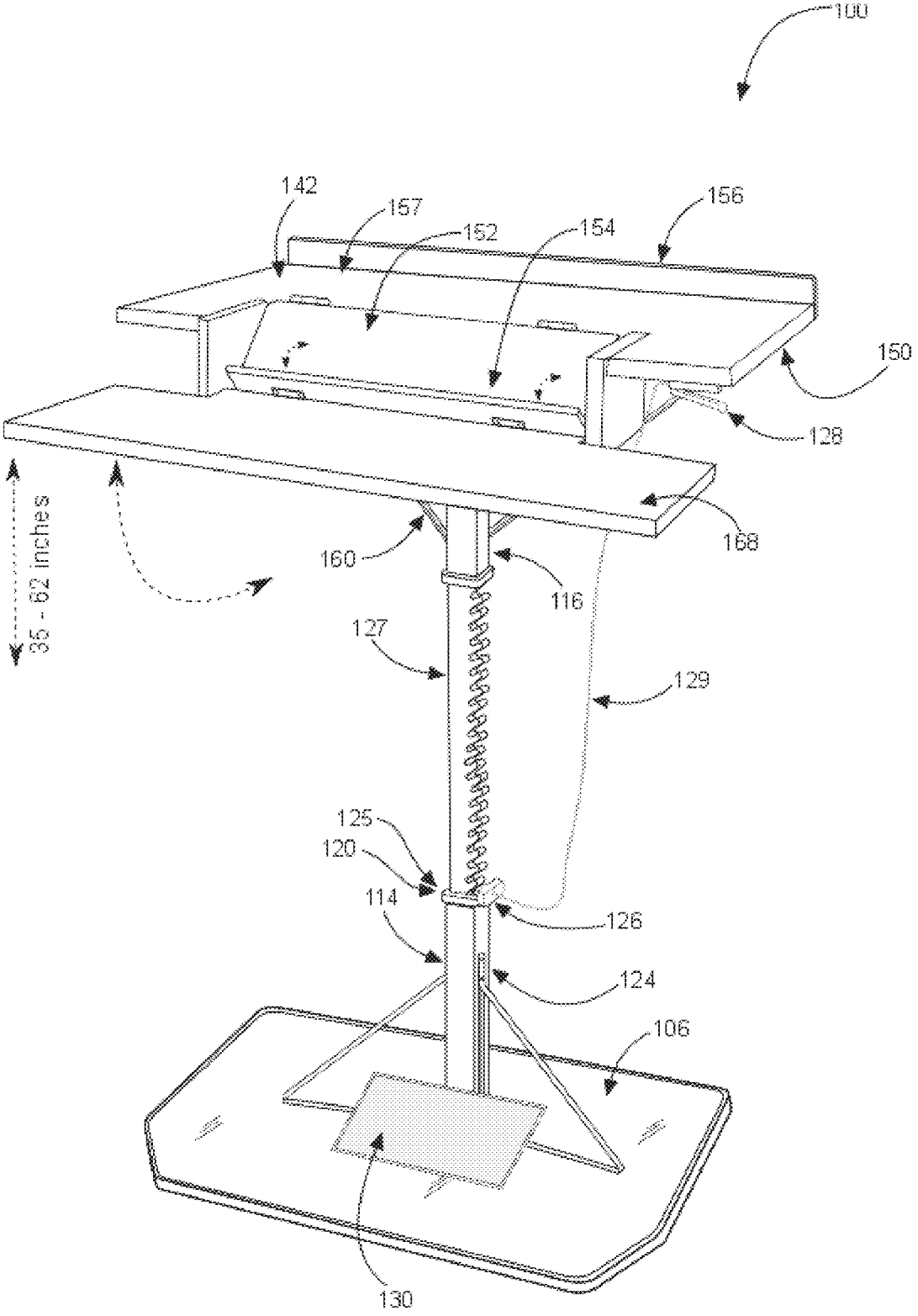
FIG. 4 is a perspective view illustrating an improved computer stand in a raised position according to an embodiment of the present invention of FIG. 1.

Referring now to FIG. 4, a perspective view illustrating an improved computer stand 100 in a raised position according to an embodiment of the present invention.

Lower section 124 of support stem 114 includes female connector member 125 attached thereto formed having a hollow cylindrical shape and releasable connector member 126. Releasable connector member 126 between two telescoping members 116 is formed as ratchet member 127 and includes handle portion 128 mechanically connected to the releasable connector member via cable adapted to allow a user to adjust the length of two telescoping members 116 and thereby the length of support stem 114. Computer support member 140 further comprises an elongated rectangular retainer portion 156 attached to back surface 157 measuring 30 inches in length and a width of 2.5 inches adapted to retain objects on computer support surface 142.

Improved computer stand 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, or arrangements such as, for example, including more or less components, customized parts, different color combinations, parts may be sold separately, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. An improved computer stand used for enabling a user to work on a computer while in a sitting or standing position, comprising:

a base member;

wherein said base member is adapted to be placed on a floor surface;

an adjustable support stem;

wherein said support stem is attached to said base member at a lower end thereof and adjustably extends vertically upwards from said base member;

a computer support member including:

a computer support surface;

wherein said computer support surface is adapted to extend horizontally and support a computer member thereon;

an attachment portion;

wherein said attachment portion is located in a position vertically spaced from and below said computer support surface;

a keyboard support platform;

wherein said keyboard support platform is connected to said attachment portion via a hinge member and a locking member, such that said keyboard support platform can be held in a horizontal position when in use and pivoted downwardly into a vertical position when not in use;

wherein said computer support member is adjustably connected to an upper end of said support stem; and a foot rest member;

wherein said foot rest member is vertically adjustably connected to said support stem at a lower section thereof and adapted to support the feet of a user.

2. The improved computer stand of claim 1, wherein said support stem includes at least two telescoping members releasably connected to one another via a releasable connector and thereby adjustably extends vertically from said base member.

3. The improved computer stand of claim 2, wherein said support stem is adjustable to lengths ranging from 35 inches to 62 inches.

4. The improved computer stand of claim 2, wherein said releasable connector member between said at least two telescoping members is formed as a ratchet member; wherein said ratchet member includes a handle portion mechanically connected to said releasable connector member via a cable adapted to allow a user to adjust the height of said computer support member and thereby the length of said support stem.

5. The improved computer stand of claim 1, wherein said computer support member further includes a holder portion having a holding surface and is located between said computer support surface and said attachment portion and angled relative to said computer support surface and adapted to hold material thereon for a user to view while working on said computer.

6. The improved computer stand of claim 5, wherein said computer support surface is formed as a platform member having a width and length larger than a width and length of said holder portion.

7. The improved computer stand of claim 6, wherein said platform member is formed from wood.

8. The improved computer stand of claim 1, wherein said lower section of said support stem includes a female connector member attached thereto formed having a hollow cylindrical shape and a releasable connector member; and wherein said foot rest member includes a male connector member formed having a cylindrical shape adapted to be adjustably connected within said female connector member of said support stem and releasably connected with said releasable connector member to thereby vertically and pivotally adjustably connect said foot rest member to said support stem.

9. The improved computer stand of claim 8, wherein said male connector member of said foot rest member further comprises an extension arm extending therefrom and a ball member on a distal end of said extension arm; and wherein said foot rest member includes a socket portion on a lower surface thereof adapted to adjustably receive said ball member therein, such that the angle of said foot rest member with respect to said support stem can be adjusted.

10. The improved computer stand of claim 1, wherein said computer support surface is formed having a width of 30 inches.

11. The improved computer stand of claim 1, wherein said support stem is formed from a metallic material.

12. The improved computer stand of claim 1, wherein said computer support surface is formed having a flat and rectangular shape.

13. The improved computer stand of claim 1, further comprising at least one support bracket member connected between said support stem and a bottom surface of said computer support member.

14. The improved computer stand of claim 1, further comprising at least one support bracket member connected between said support stem and a top surface of said base member.

15. The improved computer stand of claim 1, wherein said computer support member further comprises an elongated rectangular retainer portion attached to a back surface thereof adapted to retain objects on said computer support surface.

16. The improved computer stand of claim 15, wherein said retainer portion is formed having a length of 30 inches and a width of 2.5 inches.

* * * * *